US006491324B1

(12) United States Patent
Schmitz et al.

(10) Patent No.: US 6,491,324 B1
(45) Date of Patent: Dec. 10, 2002

(54) SAFETY DOCUMENT

(75) Inventors: Christian Schmitz, Schliersee (DE); Theo Burchard, Gmund (DE)

(73) Assignee: Giesecke & Devrient GmbH, Munich (DE)

( * ) Notice: Subject to any disclaimer, the term of this patent is extended or adjusted under 35 U.S.C. 154(b) by 0 days.

(21) Appl. No.: 09/462,495

(22) PCT Filed: Jul. 24, 1998

(86) PCT No.: PCT/EP98/04645

§ 371 (c)(1),
(2), (4) Date: Apr. 10, 2000

(87) PCT Pub. No.: WO99/04983

PCT Pub. Date: Feb. 4, 1999

(30) Foreign Application Priority Data

Jul. 24, 1997 (DE) ..... 197 31 968

(51) Int. Cl.[7] ..... B42D 15/00

(52) U.S. Cl. ..... 283/82; 235/487; 235/493; 283/72; 283/81; 283/94; 283/901; 428/199; 428/916

(58) Field of Search ..... 283/72, 81, 82, 283/94, 101, 109, 901, 110, 904; 428/42.1, 199, 916; 40/630; 235/379, 380, 487, 491, 493, 462.01; D19/9

(56) References Cited

U.S. PATENT DOCUMENTS 3,497,411 A * 2/1970 Chebiniak
4,682,794 A * 7/1987 Margolin ..... 283/82
4,763,927 A * 8/1988 Schneider ..... 283/70
4,806,740 A * 2/1989 Gold et al. ..... 235/449
4,852,911 A * 8/1989 Hoppe ..... 283/109
4,855,583 A * 8/1989 Fraser et al. ..... 235/492
4,992,353 A * 2/1991 Rodakis et al. ..... 430/213
5,267,755 A * 12/1993 Yamauch et al. ..... 283/86
5,354,099 A * 10/1994 Kaule et al. ..... 283/85
5,388,862 A * 2/1995 Edwards ..... 283/82
5,516,153 A * 5/1996 Kaule ..... 283/85
5,573,584 A * 11/1996 Ostertag et al. ..... 106/417
5,573,639 A * 11/1996 Schmitz et al. ..... 162/104
5,599,047 A * 2/1997 Kaule et al. ..... 283/85
5,688,587 A * 11/1997 Burchard et al. ..... 283/70
5,803,503 A * 9/1998 Kaule et al. ..... 283/85
5,876,068 A * 3/1999 Schneider et al. ..... 283/86
5,961,152 A * 10/1999 Washburn et al. ..... 283/72
6,030,691 A * 2/2000 Burchard et al. ..... 283/111
6,068,301 A * 5/2000 Han et al. ..... 283/82
6,127,034 A * 10/2000 Chorley ..... 428/375
6,186,398 B1 * 2/2001 Kato et al. ..... 235/449
6,196,594 B1 * 3/2001 Keller ..... 283/82
6,210,777 B1 * 4/2001 Vermeulen et al. ..... 283/72

* cited by examiner

*Primary Examiner*—A. L. Wellington
*Assistant Examiner*—Monica Carter
(74) *Attorney, Agent, or Firm*—Bacon & Thomas, PLLC

(57) ABSTRACT

The invention relates to a security element for protecting objects which has at least one mechanically testable magnetic layer and at least one further layer consisting of a layer semitransparent in the visual spectral region. The semitransparent layer is additionally disposed over the magnetic layer so as to cover the magnetic layer. The invention further relates to a security document with such a security element.

41 Claims, 6 Drawing Sheets

SAFETY DOCUMENT

BACKGROUND OF THE INVENTION

1. Field of the Invention

This invention relates to a security document such as a bank note, security, ID card or the like with a security element having at least one mechanically testable magnetic layer and at least one further layer.

2. Description of the Related Art

It has been known for some time to provide security documents such as bank notes or ID cards with magnetic security elements. German patent no. 16 96 245 discloses for example an antifalsification paper in which a security thread with a ferromagnetic coating is embedded. The customarily used magnetic material has a very dark body color, however, so that the security thread is recognizable as a dark strip on the paper surface even when embedded completely in the paper. In order to avoid this disadvantage German patent no. 16 96 245 already proposes additionally providing the thread coated with magnetic material with an opaque white coating on both sides to avoid the optical effect of the magnetic material on the paper surface.

It is further known from German patent no. 27 54 267 to equip a security thread with a magnetic coating and a further security feature. An important selection criterion for the security features to be combined is that the features not be readily recognizable and imitable for a forger. For this reason the magnetic layer is combined for example with a metal layer or an opaque lacquer fluorescent under UV light. However, the measures described in German patent no. 27 54 267 only increase forgery-proofness in case the document is actually checked by machine. The described security features do not, or not readily, permit visual checking of the document's authenticity.

Therefore, a security thread has also been proposed (WO92/11142) which permits both a mechanical check of magnetic properties and a visual authenticity check. In this case the magnetic layer is combined with an opaque metal layer having gaps in the form of characters or patterns, the magnetic layer being disposed under the metal layer, as regarded by the viewer, so that the optical effect of the magnetic material does not appear on the paper surface. The gaps are virtually unrecognizable in the paper in reflected light but stand out in high contrast from their opaque surroundings in transmitted light. This presupposes, however, that the left-out areas of the characters are transparent, i.e. there must be no magnetic material in the area of the characters. When producing the security element one must therefore make sure that the magnetic layer and visually recognizable characters are produced in register with each other so that they do not overlap.

BRIEF SUMMARY OF THE INVENTION

The invention is based on the problem of proposing a security document with a security element which has a magnetic coating whose inherent color hardly appears in reflected light and which can be provided with additional visually testable features in a simple way.

It has surprisingly turned out that a cover layer semitransparent in the visual spectral region already suffices to weaken the dark appearance of the magnetic material so as to avoid the usually undesirable optical effects. The semitransparent cover layer additionally makes it possible to provide the security element with visually and/or machine recognizable information, e.g. by providing gaps in the form of characters in the magnetic layer or forming the magnetic layer itself in the form of visually and/or machine recognizable characters or patterns. No exactly registered arrangement of cover layer and magnetic layer is necessary any longer in this case since the visually recognizable information is recognizable through the semitransparent layer.

In its simplest embodiment, the security element therefore consists of a magnetic layer and a semitransparent layer covering the magnetic layer.

According to a preferred embodiment, the semitransparent layer consists of a thin semitransparent metal layer. With sufficient layer thickness, a semitransparent metal layer has optical reflection properties which are very similar to an opaque metal layer.

This can be utilized advantageously in the production of security threads, which are usually embedded at least partly in antifalsification paper. In the areas where the thread is embedded completely in the paper it is hardly recognizable on the paper surface in reflected light since the magnetic layer is covered sufficiently by the metal layer. In transmitted light, however, the thread appears as a dark strip in high contrast with the surroundings like an opaque metallic thread.

Instead of a contiguous semitransparent metal layer, one can of course also use other semitransparent materials or layers, such as printing inks with optically variable interference layer pigments, liquid crystal layers or diffraction structures with a semitransparent reflecting layer.

According to a further preferred embodiment, the semitransparent layer of the security element is formed by a screened layer, the individual screen elements being opaque, preferably metallic. The screen elements can have any desired form. One can use standard geometric shapes such as dots, lines, triangles, etc., as well as special patterns, numbers, letters, etc. The screen width is selected so as to effect a sufficient cover of the magnetic layer while any information present under the screened layer simultaneously also remains recognizable. The screen elements can be produced with the aid of any printing ink, but preferably a white or light ink, or by any coating methods, such as vapor deposition, hot embossing, etc.

The magnetic layer can be provided either all over or only in certain areas independently of the kind of cover layer used. According to a preferred embodiment, the magnetic layer is applied in the form of a coding, in particular a bar code. However, the magnetic layer can also contain only gaps in the form of visually and/or machine recognizable characters. Additionally, further visually and/or machine recognizable information can be disposed in the magnetic layer free areas of the code or in the gaps.

According to a special embodiment, the magnetic layer free areas can be filled for example with a nonmagnetic layer having the same color as the magnetic material. This additionally disguises the presence of a magnetic code. This nonmagnetic layer can also have gaps in the form of characters, patterns, etc.

The inventive combination of a magnetic layer and a semitransparent cover layer makes it possible not only to provide testable information in the magnetic layer, however, but also to include the semitransparent cover layer in the design of the security element. This yields a great variety of embodiments which have, along with various specific advantages, the common advantage of increasing the forgery-proofness of the security element or the object provided with this security element.

The security element can, as mentioned above, be formed as a security thread or planchets which are incorporated at least partly into a security document. It is also conceivable, however, to form the security element in a band or label shape and fasten it to the surface of an object. These objects can likewise be security documents. However, the inventive security element can also be used very advantageously in the field of product protection. In this case the security element can have, besides the inventive magnetic layer and semi-transparent cover layer, further antitheft elements such as a coil. According to a further variant, the security element can also be provided on or in a document material which is in turn applied to any-shaped objects for product protection.

BRIEF DESCRIPTION OF THE DRAWINGS

The various embodiments and their advantages will be explained in more detail in the following with reference to the figures, in which.

DETAILED DESCRIPTION OF THE PREFERRED EMBODIMENT

Figure 1:
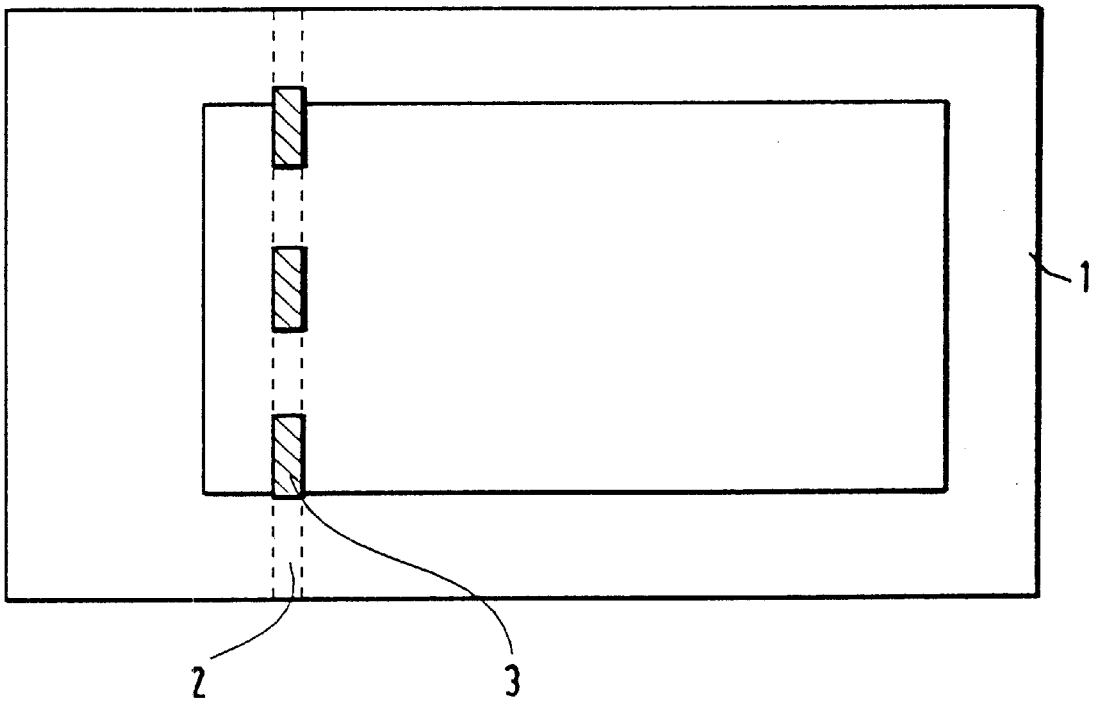
FIG. 1 shows an inventive security document.

FIG. 1 shows security document 1 according to the invention. In the present case one can see a bank note in which security thread 2 is embedded in the form of a so-called "window security thread". Security thread 2 is quasi woven into the paper during papermaking and passes to the surface of the paper at certain regular intervals. These areas 3 are hatched here.

The term "security document" is not restricted to bank notes however. It can refer to any document of value such as a check, share, ID card or the like.

Inventive security element 2 likewise need not necessarily be a security thread. Security element 2 can for example also be disposed completely on the surface of security document 1 as a thin layer sequence or self-supporting label. The form of the particular element is likewise freely selectable. Element 2 can for example extend in a strip shape from one edge of document 1 to the opposite edge, or alternatively be executed in an island shape with any desired contours.

If the security element is to be provided only as a thin layer sequence on the security document, it is useful to prepare the layer sequence of the security element separately on a foil material and subsequently transfer it to the document. In this case the layers must be present on the transfer foil in the reverse order to that which is desired on the document later.

Figure 2:
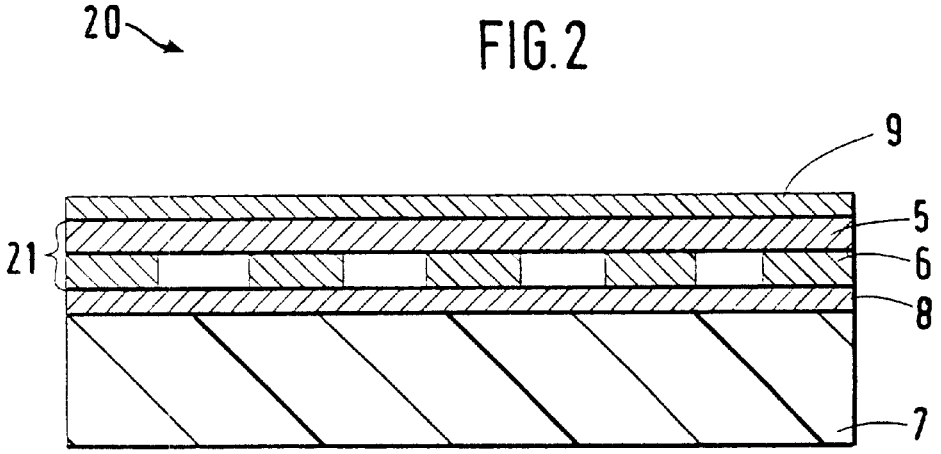
FIG. 2 shows inventive foil material in the form of a transfer band for producing a security element in cross section.

FIG. 2 shows a possible embodiment of such a foil material whereby transfer foil 20 shown has the form of a band. Carrier 7, for example a transparent plastic foil, is provided in a first step, if necessary, with separation layer 8 which ensures that the layer structure of security element 1 can be detached from carrier 7 after transfer to the security document. One then applies to separation layer 8 first cover layer 6 semitransparent in the visible spectral region, followed by magnetic layer 5. Cover layer 6 is shown in this example as a screened layer with a constant screen width. One finally provides over magnetic layer 5 adhesive layer 9 for fastening layer structure 21 to the document. This layer can be for example a hot-melt adhesive or radiation-curable adhesive.

In some cases it may be advantageous to likewise leave carrier 7 on the document as a protective layer. In this case one must of course not provide separation layer 8 on the carrier material. Instead one must take additional measures so that the layer structure of element 1 has good adhesion to carrier layer 7.

If label-like security elements are to be transferred in certain places with the aid of such a transfer foil, the transfer foil can be provided with the security element layer structure all over and the latter detached and transferred from the all-over coating only in the desired areas, e.g. by selective activation of the adhesive. Alternatively, the carrier material can already be provided with the desired single elements in spaced-apart areas.

The layer sequences of the security element explained in the following can of course all be produced on such a transfer foil and subsequently transferred to the document. For clearer representation, however, security elements will only be shown and explained which consist substantially of a carrier layer and layers provided thereon for authenticity marking. Such security elements are usually fastened on or in the security document together with the carrier foil, such as security threads or labels.

Figure 3:
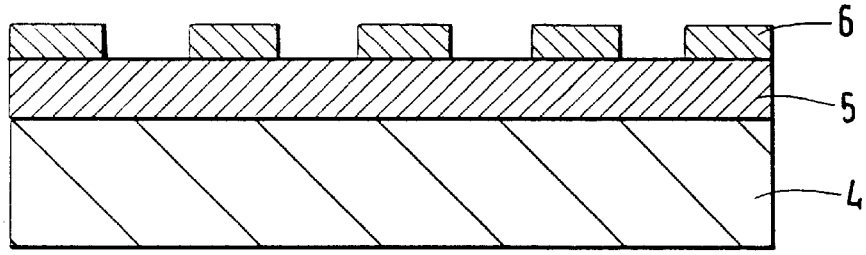
FIG. 3 shows an inventive security element with a screened cover layer in cross section.

FIG. 3 shows the layer structure of an inventive security element in the simplest embodiment. Carrier 4 is provided here all over with magnetic layer 5 over which layer 6 in the form of a screen is provided, the screen elements consisting of opaque material,. This screened layer 6 must face the viewer on the finished document in order to ensure the inventive effect of covering magnetic layer 5.

If the security element is used as a security thread, it may be useful to cover the magnetic material on the side opposite screen 6 as well. One can thus provide a further screen layer between magnetic layer 5 and carrier 4 or on the opposite surface of carrier 4, or else an all-over, preferably white or light printed layer. The white or light layer offers the advantage of the thread being well adapted to the paper in color from the underside and therefore virtually not appearing on the surface on the back of the paper.

The use of a second screened layer, however, has the advantage of the thread looking identical on the front and back and therefore not having to be incorporated into the paper true to side.

Such additional covering measures can of course also be used in the other embodiments.

Figure 4:
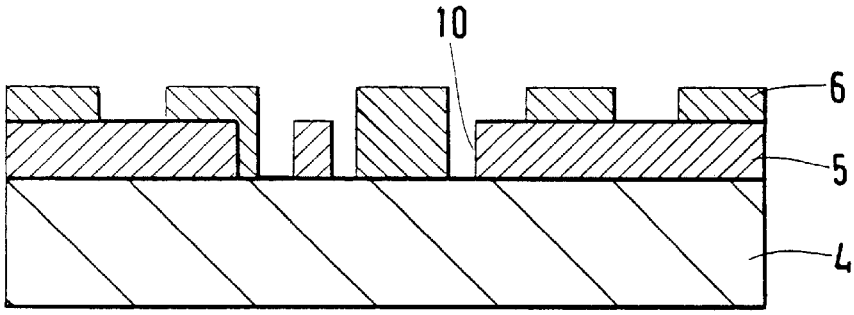
FIG. 4 shows an inventive security element with gaps in the magnetic layer and a screened cover layer in cross section.
Figure 5:
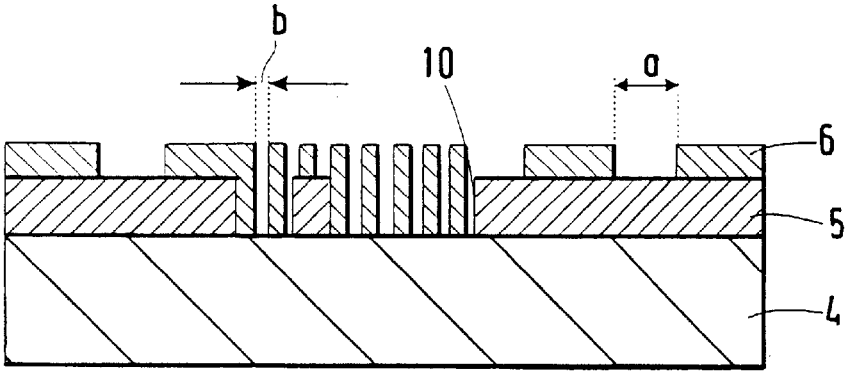
FIG. 5 shows an inventive security element with gaps in the magnetic layer and a screened cover layer, the screen width varying in the area of the gaps and in the area of the magnetic layer, in cross section.

FIG. 4 shows a security element with the layer sequence explained above with reference to FIG. 3. However, in the present case magnetic layer 5 is provided additionally with gaps 10 in the form of characters, patterns or the like. If the security element is one embedded in a paper layer, carrier 4 is advantageously executed so as to be transparent or at least translucent. This permits gaps 10 to be recognized as highly contrasting characters in the surroundings formed by opaque magnetic material 5 when viewed in transmitted light. The screen elements of layer 6 in the area of gaps 10 hardly impair this effect. When viewed in reflected light, however, screen 6 additionally disguises gaps 10 so that they virtually do not appear. As discussed above, screened layer 6 also suffices to cover the dark appearance of magnetic layer FIG. 5 shows a further variant of the inventive security element which, as explained above with reference to FIG. 4, consists of carrier layer 4, magnetic layer 5 with gaps 10 in the form of visually recognizable information and screened layer 6. In the area of gaps 10, however, the screen width of layer 6 was varied. FIG. 5 shows the case that screen width a in the area of the magnetic material is greater than screen width b in the area of gaps 10. The reverse case that screen width a is smaller than screen width b is of course likewise possible. Depending on the choice of screen widths a, b gaps 10 in magnetic layer 5 can be more emphasized or hidden.

Figure 6:
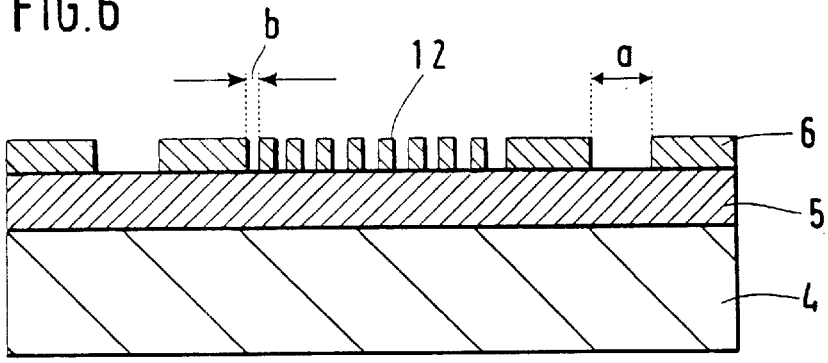
FIG. 6 shows an inventive security element with a screened cover layer, information being represented in the cover layer by variation of the screen widths, in cross section.

FIG. 6 shows an embodiment of inventive security element 2 wherein magnetic layer 5 is present on carrier 4 all over and only screened cover layer 6 contains readable information 12. The latter is represented by variation of the screen width. FIG. 6 shows again the case that screen width a is greater than screen width b in the area of information 12. The reverse case is of course possible here too. This security element has the advantage that magnetic layer 5 is covered sufficiently while visually and/or machine recognizable information is simultaneously present which is produced in a simple way in the same operation with application of cover layer 6.

Figure 7:
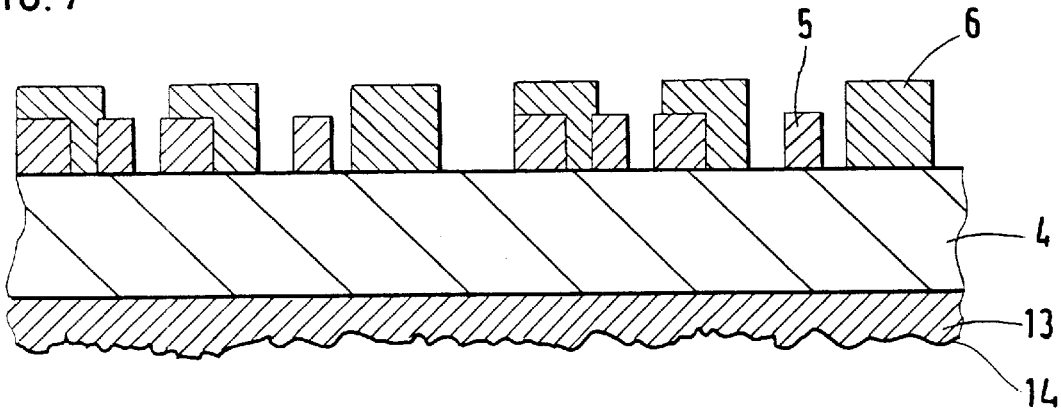
FIG. 7 shows an inventive security element with diffraction structures, a magnetic code and a screened cover layer in a longitudinal section.

FIG. 7 shows an embodiment of the inventive security element which has not only a magnetic authenticity feature but also an optically variable, visually testable authenticity feature. The security element is shown in a longitudinal section here in order to better illustrate the special design of magnetic layer 5 in the form of a coding. Carrier 4 is for this purpose provided on one of its surfaces with magnetic authenticity feature 5, having the form of a magnetic code in the present case. Inventive cover layer 6 is disposed over magnetic layer 5. On the opposite surface of carrier 4 there is layer 13 whose surface facing away from carrier 4 is provided with a diffraction structure in the form of a relief structure. In order to permit the information stored in this relief structure to be made visible, layer 13 is provided with reflecting layer 14.

Depending on whether the element is to be checkable in transmitted light or only from one side, the individual layers can be designed differently. In case the element is to be testable in transmitted light, carrier 4 must consist of a transparent or at least translucent material. Reflecting layer 14 must likewise be an at least semitransparent layer. It can consist for example of a transparent lacquer having a refractive index different from layer 13, or of a semitransparent metal layer.

An especially advantageous embodiment results, however, if reflecting layer 14 is formed as a screen, the screen elements consisting of an opaque metal layer. In this case one can observe the optically variable information in reflected light, on the one hand, and magnetic layer 5 applied to the opposite surface of carrier 4, on the other hand. This is of special interest if magnetic layer 5 is not present on carrier 4 in the form of a coding as shown in FIG. 7, but has gaps 10 in the form of characters, as shown in FIGS. 4 and 5. Diffraction structure 13 and reflecting layer 14 serve here as an additional cover layer for magnetic layer 5, in particular if the security element is embedded in antifalsification paper as a window security thread. If diffraction layer 13 with transparent reflecting layer 14 in the window areas faces the viewer, the latter will recognize primarily the optically variable effects in reflected light. Only in transmitted light do gaps 10 in magnetic layer 5 become visible through the gaps in the screen. Screened layer 6 disposed over magnetic layer 5 serves here to make the thread inconspicuous even when the back of the paper is viewed, i.e. to cover the dark magnetic layer.

It is also conceivable to form reflecting layer 14 as an opaque metal layer. If cover layer 6 faces the observer in this case, he can observe the diffraction structure only in the magnetic layer free and cover layer free areas. If magnetic layer 5 has gaps in the form of characters for example, these characters show the optically variable effect of layer 13. When the element is viewed from the back, however, the viewer only recognizes the optically variable information. Opaque reflecting layer 14 prevents recognition of magnetic layer 5 on the opposite carrier surface.

In some situations it may be advantageous if the surfaces of the element can only be tested separately from each other. In this case, carrier material 4 must be opaque. Reflecting layer 14 can in this case be designed at will.

For all stated examples it furthermore holds that the diffraction structure need not necessarily be embossed into a separate layer, such as a lacquer layer. It can of course also be incorporated directly into the surface of carrier material 4.

Figure 8:
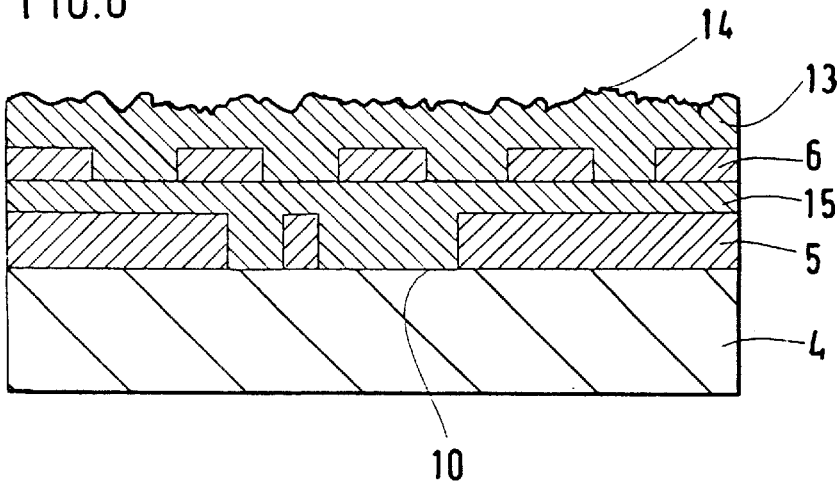
FIG. 8 shows an inventive security element with gaps in the magnetic layer, an additional diffraction structure and fluorescent layer in cross section.

A further embodiment according to the invention provides for disposing all security-relevant layers on a surface of carrier 4, as shown in FIG. 8. Here, magnetic layer 5, which in the present case has gaps 10 in the form of characters or patterns, is first provided on carrier 4. Located thereover is transparent lacquer layer 15 with at least one luminescent substance emitting when excited with radiation outside and/or inside the visible spectral region. Disposed thereover is cover layer 6, shown here in the form of a regular screen. The last layer is lacquer layer 13 into which diffraction structures in the form of a relief structure are incorporated, and reflecting layer 14. Reflecting layer 14 must likewise be semitransparent in the present case, in order to permit visual and/or mechanical recognizability of gaps 10 incorporated in magnetic layer 5 in transmitted light. As mentioned above, it can consist of a semitransparent metal layer or a screened opaque metal layer or else a transparent lacquer layer with a different refractive index. Luminescent layer 15 can of course also contain a plurality of luminescent substances or have a plurality of merging areas of different emission wavelengths, resulting in rainbow fluorescence. Application in the form of patterns is also possible. In order to protect the security element from environmental influences and mechanical loads, it can be additionally provided with a protective layer, e.g. a transparent lacquer layer, which is not shown in the figure.

Figure 9:
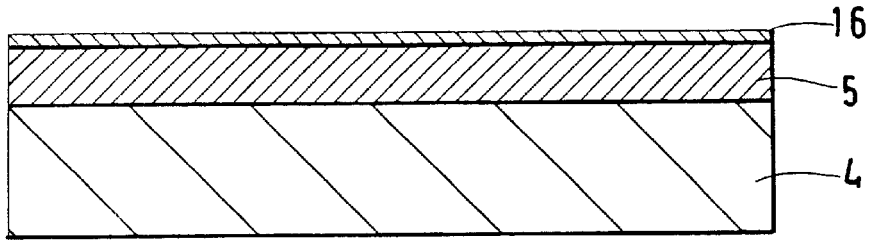
FIG. 9 shows an inventive security element with a semitransparent, all-over cover layer in cross section.

FIG. 9 shows a further variant of the invention wherein the cover layer no longer consists of a screened layer with opaque screen elements. Instead one uses a semitransparent layer 16, preferably a semitransparent metal layer, which is applied to magnetic layer 5. As explained above in connection with the screened cover layer, the semitransparent layer can also be used to incorporate visually recognizable information.

Figure 10:
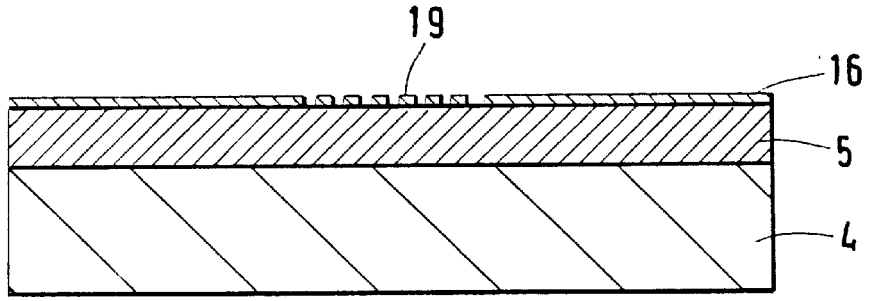
FIG. 10 shows an inventive security element with a semitransparent cover layer interrupted in certain areas by a screening, in cross section.

As shown in FIG. 10, this can be done by providing a screen in the area of information 19.

Figure 11:
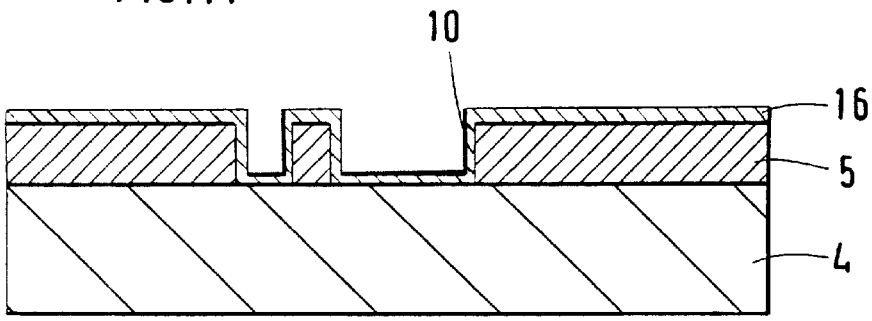
FIG. 11 shows an inventive security element with gaps in the magnetic layer and a semitransparent cover layer in cross section.

FIG. 11 shows the case that magnetic layer 5 is provided with gaps 10 in the form of characters, patterns or the like and semitransparent layer 16 is disposed thereover. Here, too, the characters are recognizable in transmitted light as information in high contrast to its surroundings, while they hardly appear when viewed in reflected light.

Figure 12:
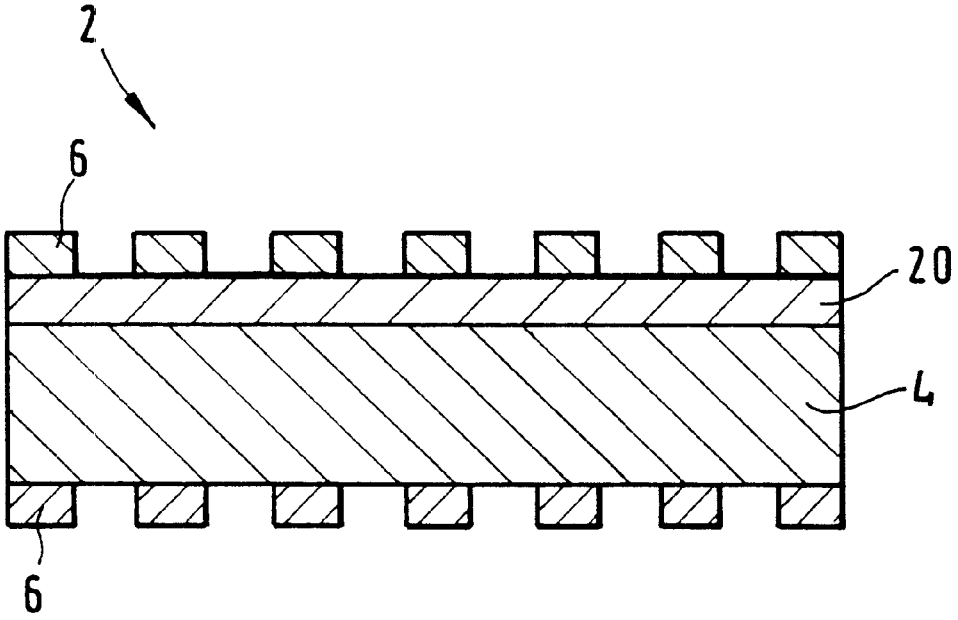
FIG. 12 shows a special embodiment of the inventive security element in cross section.

FIG. 12 shows a further embodiment of inventive security element 2. In this case carrier 4 is provided on one side with layer 20 which is covered by screened cover layer 6, shown here in the form of a regular screen. On the opposite side of carrier 4 there is identical screened layer 6 which ensures that the security element shows an identical appearance from both sides. However, second screened layer 6 applied to the underside of carrier 4 could alternatively be disposed between layer 20 and carrier 4 or be lacking completely. Layer 20 is an all-over layer which is uniform in color but composed of materials with different properties.

Figure 13:
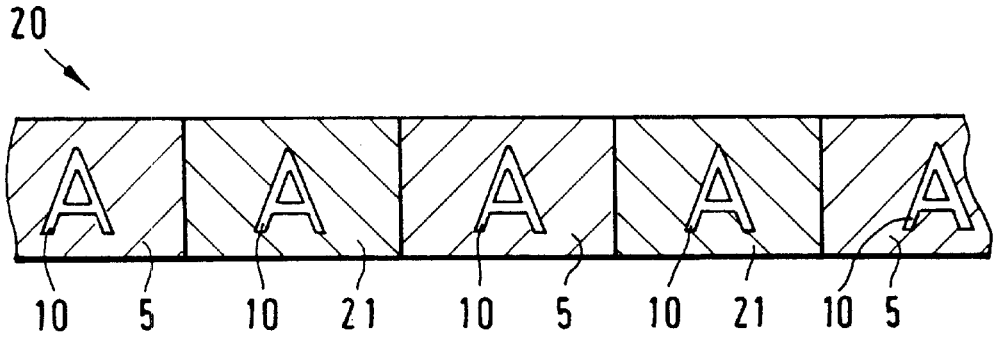
FIG. 13 shows a special embodiment of layer 20 shown in FIG. 12, in a plan view.
Figure 14:
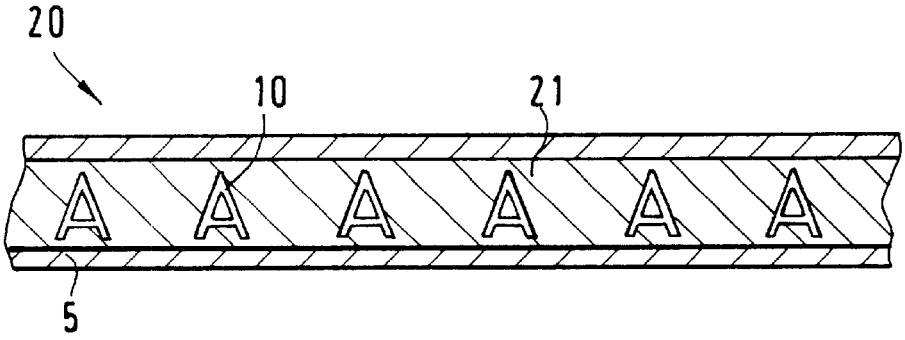
FIG. 14 shows a further special embodiment of layer 20 shown in FIG. 12, in a plan view.
Figure 15:
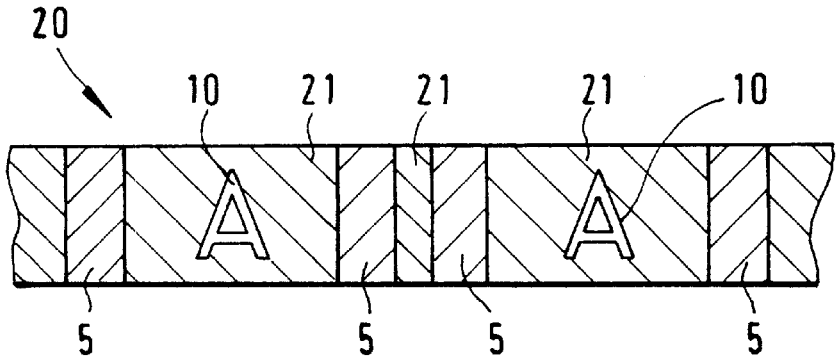
FIG. 15 shows a further special embodiment of layer 20 shown in FIG. 12, in a plan view.

FIGS. 13 to 15 show various embodiments of layer 20 in a plan view. In these examples, layer 20 forms a contiguous layer extending over at least a partial area of carrier 4.

According to FIG. 13, layer 20 is composed of alternatingly disposed areas 5 and 21, which are separated by lines in the figure for purposes of clarity. Actually these areas cannot be distinguished visually since they are identical in color. In areas 5, however, there is magnetic material which can be detected mechanically, while in intermediate areas 21 there is a material of the same color without magnetic properties. Magnetic areas 5 can represent a coding. As shown in FIG. 13, both magnetic areas 5 and nonmagnetic areas 21 can have gaps 10 in the form of readable information. Gaps 10 can also be dispensed with, however.

FIG. 14 shows another relative arrangement of magnetic areas 20 and nonmagnetic areas 21. Here, magnetic material 5 is disposed in register with gaps 10 provided in the nonmagnetic areas in the edge area of the security element. FIG. 14 shows magnetic areas 5 as all-over so-called "magnetic tracks" extending parallel to gaps 10. Alternatively it is also conceivable to interrupt these tracks and thus produce a magnetic coding disposed parallel to gaps 10. The intermediate areas of the magnetic coding would likewise have to be filled with nonmagnetic layer 21 in this case.

FIG. 15 likewise shows an embodiment of layer 20 in a plan view. Here, magnetic areas 5 likewise form a coding whose intermediate areas are filled by nonmagnetic layer 21 of identical color. Gaps 10 are only located in nonmagnetic areas 21 in this example.

Figure 16:
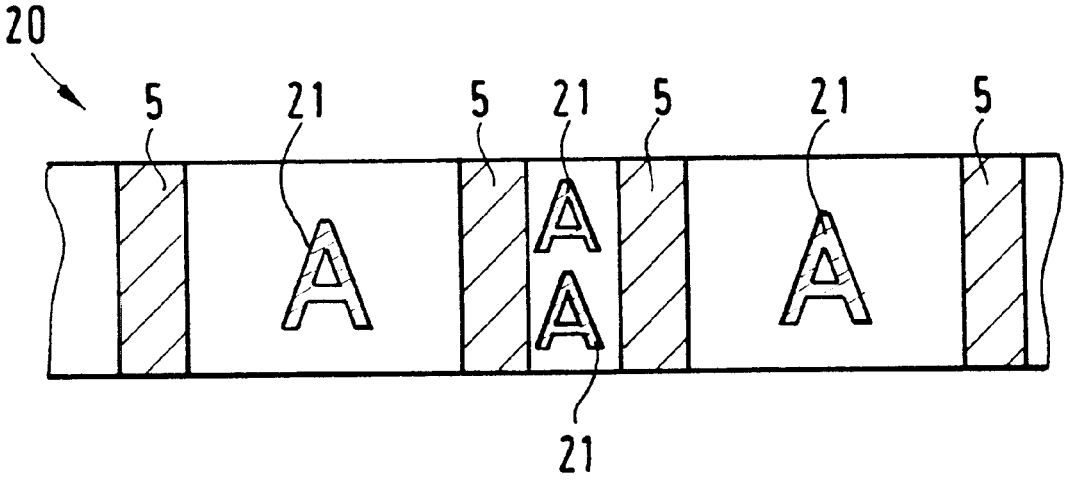
FIG. 16 shows a further special embodiment of layer 20 shown in FIG. 12, in a plan view.

FIG. 16 finally shows a further possible embodiment of layer 20. In this example, layer 20 is noncontiguous, being composed of separate magnetic areas 5 and nonmagnetic areas 21. As shown in FIG. 16, nonmagnetic areas 21, which are identical in color to magnetic areas 5, can represent for example readable information, patterns or the like. The latter can also vary in size or information content depending on the distance between magnetic areas 5.

It holds for all embodiments that the variants of representation shown for the magnetic layer (e.g. magnetic coding) and the cover layer (e.g. different screen widths) can be combined with each other at will within the scope of the invention. Additional features such as an optically variable layer, a fluorescent layer or another additional layer can also be integrated into all embodiments shown. The optically variable layers can, as shown in the figures, be embossed diffraction structures representing for example cinegrams, moviegrams or holograms. One can of course also use other optically variable layers such as transparent or opaque interference layers. The latter can be vapor deposited directly on the element or admixed to a printing ink in the form of pigments. Opaque special-effect inks are in particular also suitable for producing the screened cover layer.

The inventive security elements are produced in a simple way by providing a carrier material such as plastic foil or paper with the authenticity features and then cutting it into individual elements of the desired form. For use as labels, one of the surfaces must additionally be coated with adhesive. If only the element layer structure without carrier material is to be provided on the document, one prepares a separate transfer band, e.g. a hot embossed foil, with the element layer structure and then transfers parts thereof to the document or the document material present in endless form e.g. under the action of heat and pressure. The security elements can also already be produced on the transfer band with their final contours and then transferred. The magnetic layer can either be printed (e.g. by screen printing) or applied by coating methods. If the magnetic layer has gaps in the form of characters or patterns, etc., or if it is formed as a magnetic code, one can dispose further visually and/or mechanically readable information in the magnetic layer free intermediate areas according to a further embodiment. Said information can be formed for example by characters or the like which are produced with a printing ink containing metallic pigments or by metalization methods such as hot stamping, etc.

The cover layer can likewise be produced by printing technology. In the case of the screened cover layer it is in particular suitable to use metallic pigment containing, white or light printing inks. However, one can also use printing inks containing special coloring pigments such as optically variable interference layer pigments with body colors.

If a solid metal layer is used for the cover layer, however, it must be applied by metalization methods. The semitransparent all-over cover layer can be produced in a simple way by vacuum metalization. An interrupted metal layer can likewise be produced by vapor deposition using masks. Alternatively, the metal layer can be applied all over in the first step and then removed in the desired areas by etching techniques. A further possibility is offered by methods of applying an antistick layer in the areas to be removed later. After the all-over coating with metal the antistick layer is dissolved chemically and the superjacent metal layer thus removed.

If the inventive security elements are used as security threads, it may be advantageous to construct the security element symmetrically. In this case one produces two carriers with the same layer sequence and glues them together so that the feature layers come to lie between the carriers. This protects them from harmful environmental influences such as moisture or corrosion. It frequently suffices, however, to apply the security-relevant layers to a carrier and to provide the layers with a protective lacquer layer or laminate on a protective foil layer in a last step.

It may likewise be useful to provide a cover layer below the magnetic layer as well, so that the security element shows the same appearance from both sides.

The security elements or security documents shown and explained can also be used for protecting a great variety of products. For example, one can use a security element according to the invention to provide further protection for antitheft labels, which usually communicate with control devices via coils or complicated electronic circuits. One can also apply a security document, for example bank-note paper, having a security element according to the invention to any objects such as CDs, books, etc., as a certificate of authenticity.

What is claimed is:

1. A security element for protecting objects comprising:

at least one machine testable magnetic layer; and at least one additional layer, wherein said additional layer is a semitransparent layer in a visual spectral region and comprises a screened layer having opaque screen elements incorporated therein, wherein said semitransparent layer covers the magnetic layer such that said magnetic layer remains at least partly visually recognizable under the semitransparent layer.

2. The security element according to claim 1, wherein the opaque screen elements are selected from a group consisting of a light printing ink, a printing ink containing metallic pigments, a metallic effect ink and a metal layer.

3. The security element according to claim 1, wherein visually recognizable information is present in the screened layer.

4. The security element according to claim 3, wherein said visually recognizable information is represented by a variation of a screened layer width or an absence of screen elements representing desired information.

5. The security element according to claim 1 wherein machine recognizable information is present on the screened layer.

6. The security element according to claim 5, wherein said machine recognizable information is represented by a variation of a screened layer width or an absence of screen elements representing desired information.

7. The security element according to claim 1 further comprising a second opaque layer in the form of a screen or a semitransparent layer positioned under the magnetic layer.

8. The security element according to claim 1, wherein the magnetic layer forms gaps in the form of characters or patterns.

9. The security element according to claim 8, wherein visually recognizable information is disposed in said gaps of said magnetic layer.

10. The security element according to claim 8, wherein machine recognizable information is disposed in said gaps of said magnetic layer.

11. The security element according to claim 1, wherein the magnetic layer forms a coding.

12. The security element according to claim 11, wherein visually recognizable information is disposed in said coding.

13. The security element according to claim 11 wherein machine recognizable information is disposed in said coding.

14. The security element according to claim 11 wherein said coding is a bar code.

15. The security element according to claim 1, wherein the magnetic layer includes intermediate non-magnetic areas arranged between magnetic areas, said intermediate non-magnetic areas forming gaps whereat patterns or characters are located, said magnetic layer having a substantially uniform color across both said magnetic areas and said intermediate non-magnetic areas of said magnetic layer.

16. The security element according to claim 1, wherein the security element further includes security features selected from the group consisting of luminescent substances, diffraction structures and interference layers.

17. The security element according to claim 1, wherein the security element is formed on a plastic foil.

18. The security element according to claim 1, wherein the security element is provided as a self-adhesive label.

19. The method according to claim 18 wherein said plastic carrier foil includes a separation layer between the plastic carrier foil and the layer semitransparent within a visual spectral region.

20. A security document such as a security or ID card having a security element according to claim 1.

21. The security document according to claim 20, wherein the security element is embedded at least partly in the security document.

22. Foil material for producing security elements comprising a plastic foil having at least one machine testable magnetic layer and at least one additional layer disposed thereon, wherein the additional layer is a semitransparent layer and comprises a screened layer having opaque screen elements incorporated therein, said semitransparent layer covering said magnetic layer such that said magnetic layer remains at least partly recognizable under the semitransparent layer.

23. The foil material according to claim 22, wherein the foil material is formed as a transfer foil.

24. The foil material according to claim 22 having diffraction structures in the form of a relief structure.

25. A method for producing a foil material for producing security elements in the form of threads or bands which are embedded at least partly in a security document, including the following steps:

coating a plastic foil with a magnetic material;

applying a semitransparent layer within a visual spectral region and comprising a screened layer having opaque screen elements incorporated therein to the magnetic layer such that said magnetic layer remains at least partly recognizable under the semitransparent layer; and dividing the foil material into security elements of predetermined size and shape.

26. A method for producing foil material for producing security elements which are applied to the surface of objects for protection from forgery, including the following steps:

providing a plastic carrier foil;

applying a layer semitransparent within a visual spectral region and comprising a screened layer having opaque screen elements incorporated therein to one surface of the foil;

applying a magnetic layer over said semitransparent layer such that said magnetic layer remains at least partly recognizable under the semitransparent layer; and applying an adhesive layer over the magnetic layer.

27. A security element for protecting objects comprising at least one machine detectable magnetic layer and at least one additional layer, wherein the additional layer is a semitransparent layer in a visual spectral range and selected from the group consisting of a semitransparent metal layer, a layer having printing inks with optically variable interference pigments incorporated therein, a liquid crystal layer, and a layer with diffraction structures with a semitransparent reflecting layer.

28. The security element according to claim 27, further comprising a second opaque layer in the form of a screen or a semitransparent layer positioned under the magnetic layer.

29. The security element according to claim 27, wherein the magnetic layer forms gaps in the form of characters or patterns.

30. The security element according to claim 27, wherein the magnetic layer forms a coding.

31. The security element according to claim 27,wherein the magnetic layer includes intermediate non-magnetic areas arranged between magnetic areas, said intermediate non-magnetic areas forming gaps whereat patterns or characters are located, said magnetic layer having a substantially uniform color across both said magnetic areas and said intermediate non-magnetic areas of said magnetic layer.

32. The security element according to claim 27, wherein the security element is formed on a plastic foil.

33. The security element according to claim 27, wherein the security element is provided as a self-adhesive label.

34. A security document such as a security or ID card having a security element according to claim 27.

35. The security element according to claim 27, wherein visually recognizable information is present in the semitransparent layer.

36. The security element according to claim 35, wherein said visually recognizable information is represented by said semitransparent layer formed as a screen in certain areas in the form of characters or patterns.

37. The security element according to claim 27 wherein machine recognizable information is present in the semitransparent layer.

38. The security element according to claim 37, wherein said machine recognizable information is represented by said semitransparent layer formed as a screen in certain areas in the form of characters or patterns.

39. Foil material for producing security elements comprising:

a plastic foil having at least one machine testable magnetic layer at least one additional layer disposed thereon;

wherein said additional layer is a semitransparent layer in a visual spectral range and comprises a screened layer having opaque screen elements incorporated therein, said semitransparent layer covering said magnetic layer such that said magnetic layer remains at least partly recognizable under the semitransparent layer;

wherein said semitransparent layer is selected from the group consisting of a semitransparent metal layer, a layer having printing inks with optically variable interference pigments incorporated therein, a liquid crystal layer, and a layer with diffraction structures with a semitransparent reflecting layer.

40. A method for producing a foil material for producing security elements in the form of threads or bands which are embedded at least partly in a security document, including the following steps:

coating a plastic foil with a magnetic material;

applying a semitransparent layer within a visual spectral region and comprising a screened layer having opaque screen elements incorporated therein to the magnetic layer such that said magnetic layer remains at least partly recognizable under the semitransparent layer, wherein said semitransparent layer is selected from the group consisting of a semitransparent metal layer, a layer having printing inks with optically variable interference pigments incorporated therein, a liquid crystal layer, and a layer with diffraction structures with a semitransparent reflecting layer; and dividing the foil material into security elements of predetermined size and shape.

41. A method for producing foil material for producing security elements which are applied to the surface of objects for protection from forgery, including the following steps:

providing a plastic carrier foil;

applying a layer semitransparent within a visual spectral region and comprising a screened layer having opaque screen elements incorporated therein to one surface of the foil, wherein said semitransparent layer is selected from the group consisting of a semitransparent metal layer, a layer having printing inks with optically variable interference pigments incorporated therein, a liquid crystal layer, and a layer with diffraction structures with a semitransparent reflecting layer;

applying a magnetic layer over said semitransparent layer such that said magnetic layer remains at least partly recognizable under the semitransparent layer; and applying an adhesive layer over the magnetic layer.

* * * * *